United States Patent [19]

Radomsky

[11] Patent Number: 4,856,202

[45] Date of Patent: Aug. 15, 1989

[54] METHOD AND APPARATUS FOR TREATING ASPHALTIC CONCRETE PAVING MATERIALS

[75] Inventor: John Radomsky, Cedar Park, Tex.

[73] Assignee: Cyclean, Inc., Georgetown, Tex.

[21] Appl. No.: 28,581

[22] Filed: Mar. 20, 1987

[51] Int. Cl.[4] ..... F26B 3/06

[52] U.S. Cl. ..... 34/10; 34/22; 34/57 R; 34/57 A; 366/4

[58] Field of Search ..... 34/10, 57 A; 366/4, 366/7, 22, 24, 25

[56] References Cited

U.S. PATENT DOCUMENTS 3,060,590 10/1962 Brown ..... 34/20
3,229,377 1/1966 Hoyt ..... 34/10
4,096,588 6/1978 Mendenhall ..... 366/7
4,481,039 11/1984 Mendenhall ..... 366/4

*Primary Examiner*—Henry A. Bennet
*Attorney, Agent, or Firm*—Ronald R. Snider

[57] ABSTRACT

A method of heating reclaimed asphalt paving is shown and described. An air sorter removes fine materials from the reclaimed asphalt paving, and an air circulating dryer which utilizes high velocity air impingement, removes the moisture from the material. A combustion heated recirculating air dryer or dryers is used to raise the temperature of the material to a first desired temperature and a microwave heating tunnel is used to raise the temperature to a final desired temperature. A recirculating air dryer which has sufficient velocity to form clear spots between wind rows on a conveyor belt is also shown and described.

8 Claims, 4 Drawing Sheets

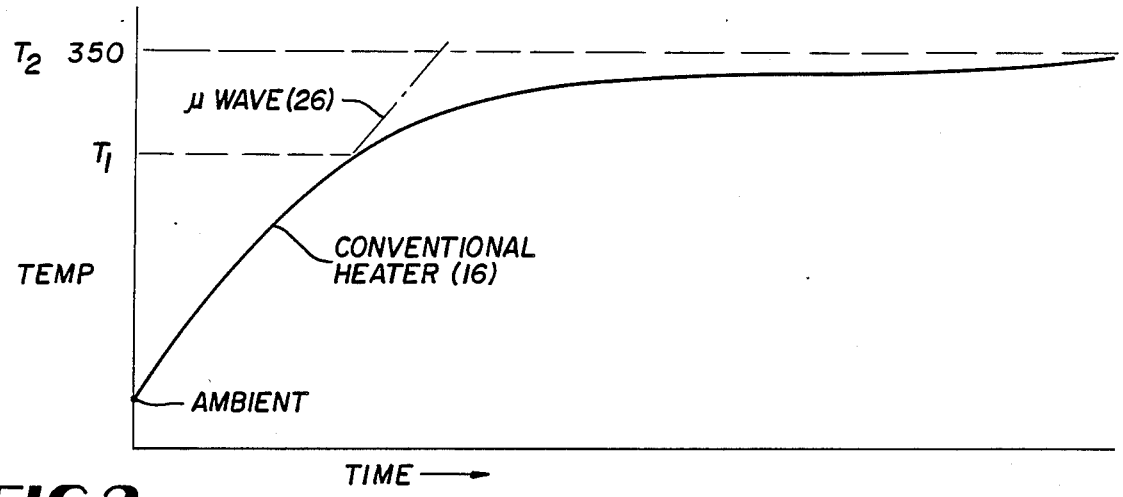
FIG. 2
FIG. 3
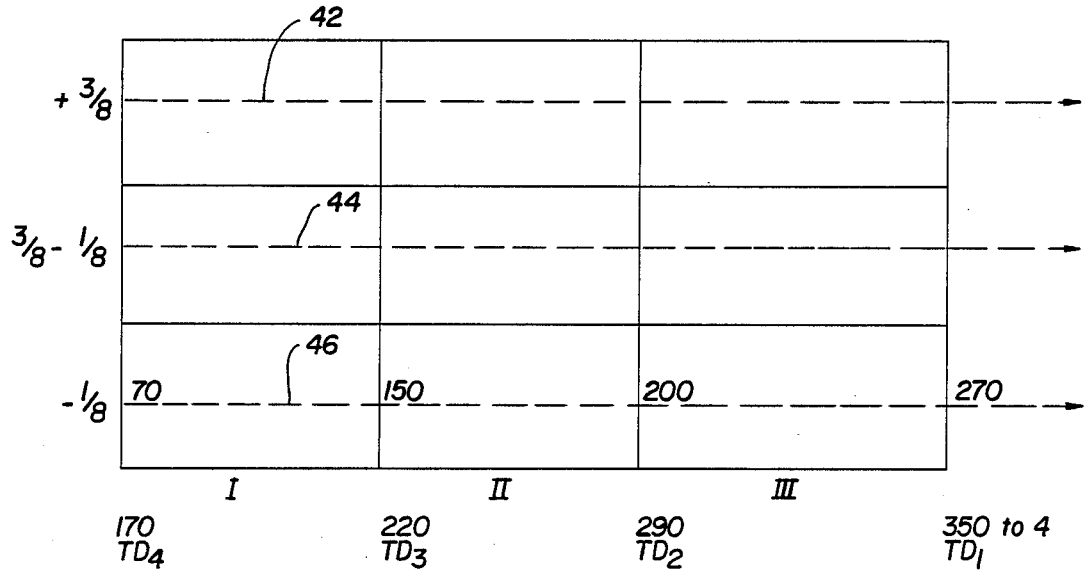
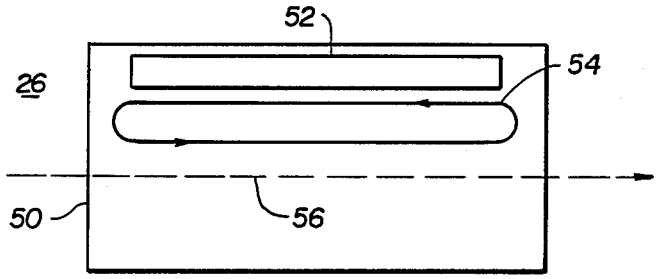
FIG. 4
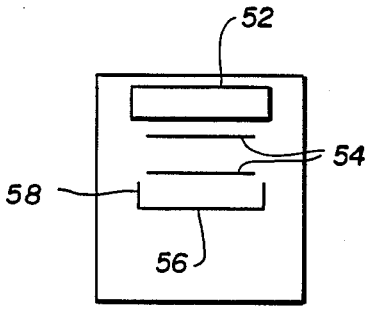
FIG. 5

FIG. 6
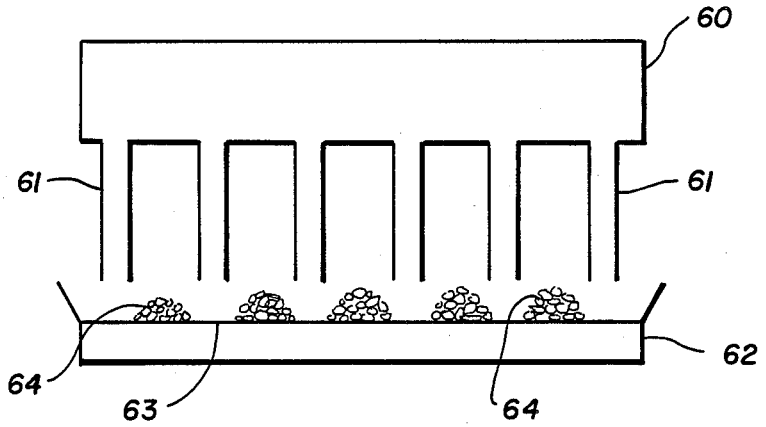
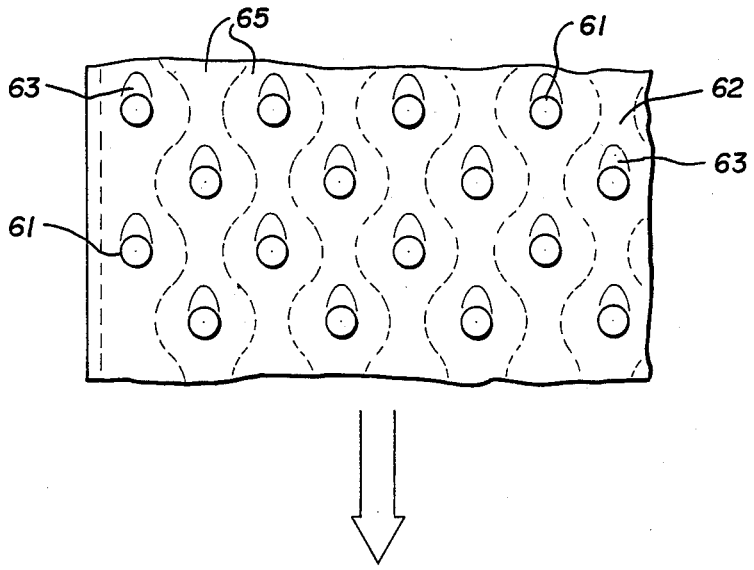
FIG. 7

FIG. 6a
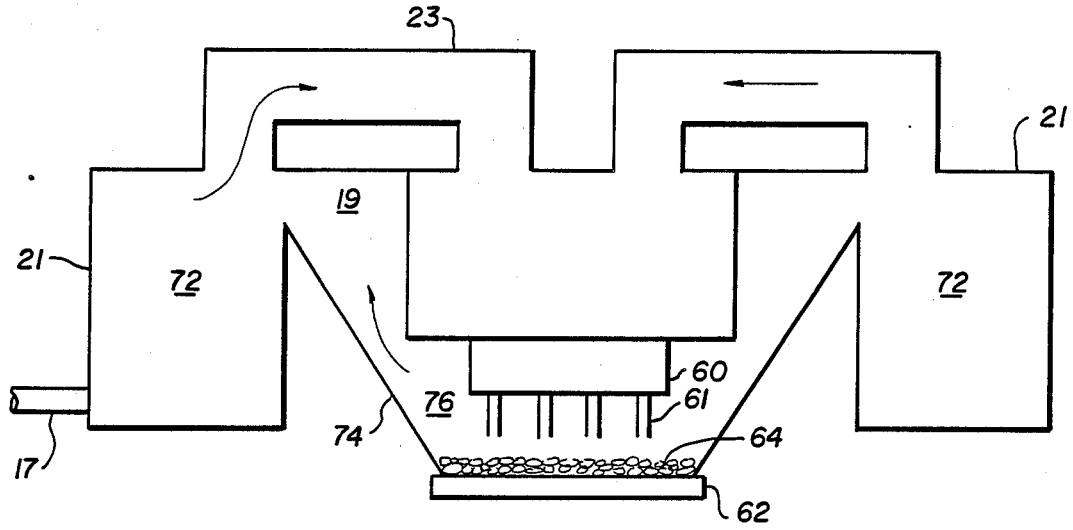
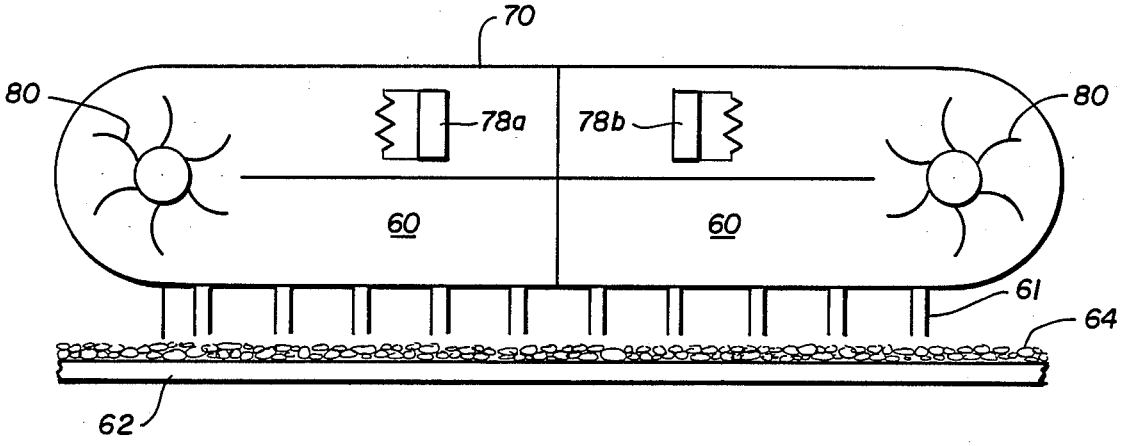
FIG. 6b

METHOD AND APPARATUS FOR TREATING ASPHALTIC CONCRETE PAVING MATERIALS

BACKGROUND OF THE INVENTION

1. Field of the Invention

This invention relates to the field of treating asphaltic concrete paving materials and the recycling of said materials. It is necessary to perform the recycling of the paving materials at the least cost per ton of material. Recycling of paving materials must also be done with minimal damage to the asphalt and with minimum air pollution. The use of hot air or high heat combustion gases to heat asphaltic paving materials and the use of microwave fields is well known in the art.

The single greatest cause of inefficiency in heating asphaltic paving is the necessity for driving off water vapor. Until such water vapor is driven off and removed from the paving materials, the materials cannot be heated to their ideal working temperature which is well in excess of the boiling temperature of water. Known methods of reclamation of asphaltic pavement are limited to approximately 50% recycled asphalt material as a practical matter. These methods produce substantial environmental degradation and damage the finished asphaltic product if more than 50% recycled material is used.

In the prior art little concern has been given to efficient heat transfer, heat utilization, and to prevention of degradation of the asphalt while maintaining overall efficiency.

There is no known economically feasible way of recycling 100% reclaimed asphalt pavement (RAP). The system of the prior art either do no work or are not economically viable.

2. Brief Summary of the Invention

This invention is a method of treating a reclaimed asphaltic concrete paving material which utilizes as its first step the removal of loose unwanted fines (small particles)from the reclaimed asphalt paving (RAP). Strictly speaking, we are not removing all fines from the RAP. These are loose fines. There is a substantial portion of fines in the RAP which is bound up by the asphalt and contained in the larger agglomerates of RAP. These agglomerated fines are dry and are needed in the final mix. It has been found that the moisture in the RAP is on the surface of the particles of the material. The small particles have a far greater surface area to volume ratio than the larger particles. The small particles have on their surfaces, the larger portion of the water in the RAP. Therefore, if the fine materials are removed prior to the heating of the RAP, a substantial savings in energy input may be achieved. It is also true that an excess of fines in the mix is unacceptable because it will not meet specifications for gradient of material.

In this invention, an air sorter used to separate out fine materials which are less than a predetermined size. The air sorter produces agitation of the RAP material which breeds small particles and enables them to be carried away. The air used in the initial air sorter may also be heated in order to begin the process of transferring heat to the RAP particles which are to be later reprocessed. The materials which are greater than the predetermined size (remaining RAP) are then first heated in a recirculating air dryer to a first predetermined temperature. The RAP at the first predetermined temperature is then heated to a higher predetermined temperature required for working the asphaltic pavement in a microwave tunnel. The elimination of vapor and moisture and dirt in the RAP layer in the recirculating air dryer makes the heating in the microwave tunnel easier because arcing and heat loss caused by these materials is substantially eliminated. By the use of these three steps, substantial energy savings are achieved by first, eliminating substantial quantities of water through the removal of fines by the air sorter, secondly, by heating the RAP to a first predetermined temperature in a recirculating air dryer which is very efficient. Still further, efficiencies are achieved by the use of the microwave radiation tunnel which allows heating of the RAP without overheating the asphaltic components. Overheating causes smoking and inefficient use of the available heat and degradation of asphalt.

Although microwave has many characteristics that make it a very good method for second stage heating, it has the disadvantage of having a high initial cost and high consumption of expensive electricity. There are several alternatives to microwave for finish heating (second stage heating). The temperature can be raised from 220° F. to a desired ending temperature with an air impingement dryer similar to the one used for the initial sorting and/or heating. Infrared heating may also be used as an alternative to microwave heating. Both infrared and air impingement dryer heating are less expensive than microwave. Both infrared and air impingement heating are slow because they must transmit heat from the surface of the RAP to the interior of the RAP by conduction.

In another embodiment of this invention, the RAP is separated into a plurality of sizes, and each of the sizes is then heated in a separate conveying and heating apparatus. By separating into groups of different sizes, different heating rates or methods may be applied to each group, thereby eliminating the problem of overheating small particles and underheating larger particles. Through particle separation, better control over the asphaltic pavement recycling operation is achieved.

The microwave heater in accordance with this invention may comprise an aluminum or stainless steel enclosed microwave heating tunnel in combination with a microwave transparent conveying belt. Still further, the microwave tunnel may provide for placement of the microwave antenna within twelve inches or more of the RAP which is being treated. The thickness of the RAP layer on the conveyor belt, the height of the wave guide above the top of the RAP, and the spacing of the microwave broadcasting antenna along the length of the tunnel are a function of the frequency of the microwave being used. The spacing of twelve inches from the antenna to the RAP refers to the distance which would be used with 915 mHz waves. The spacing will be approximately 4.5 inches if a 2,450 mHz wave is used. Arcing and undesirable dust clouds can be kept to a minimum in the region of the microwave heating element by placement of a dust shield between the microwave antenna and the RAP passing through said tunnel. The dust shield may be fiberglass cloth or other suitable fabric which is transparent to the microwave.

In the treatment of RAP with a recirculating air dryer, it has been found that the optimum drying and heating is obtained when the RAP on a conveyor is moved to the side sufficiently to expose the belt.

The recirculating air dryer utilizes tubes to provide a warm high velocity air stream to move particles on the conveyor belt. The recirculating air dryer applies heat in the range of 300°–450° F., and is of sufficient velocity so as to move the RAP particles beneath each tube sideways so as to expose a portion of the conveyor belt. The temperature is limited by that which will produce smoking of the RAP at the speed of operation of the conveyor belt. It has been found that the best drying characteristics are achieved when a portion of the belt is exposed by each tube injecting air into the RAP. The point of belt exposure coincides with the velocity which provides the most efficient air drying of the RAP. A plurality of tubes inject air onto the belt, and the RAP assumes a configuration which may be described as wind rows along the conveyor belt. As the wind rows are shifted back and forth, they expose different portions of the aggregate to the hot, high velocity air, thereby improving the drying characteristics.

BRIEF DESCRIPTION OF THE DRAWINGS

FIG. 2 shows in graphical form the way in which microwave heating and conventional heating are combined for maximum RAP treating efficiency.

FIG. 3 shows in schematic form a plurality of conveying systems, each containing different sized RAP, and wherein heat is applied in progressive steps to the conveyed RAP.

FIG. 4 shows a schematic representation of a microwave heating tunnel and conveyor system.

FIG. 5 shows an endview of the microwave tunnel of FIG. 4 and fiberglass belt 54.

FIG. 6 shows a cross-sectional view of the air dryer plenum, tubes, and conveyor belt.

FIG. 6*a* shows a cross-sectional view of a sorter recirculating air dryer as used in this invention.

FIG. 6*b* shows another cross-section of the sorter air dryer generally depicting the burner and the tubes for inserting high velocity air.

FIG. 7 shows a top view of the conveyor belt carrying RAP which is being displaced by the tubes of the hot air dryer.

DETAILED DESCRIPTION OF THE PREFERRED EMBODIMENT

Figure 1:
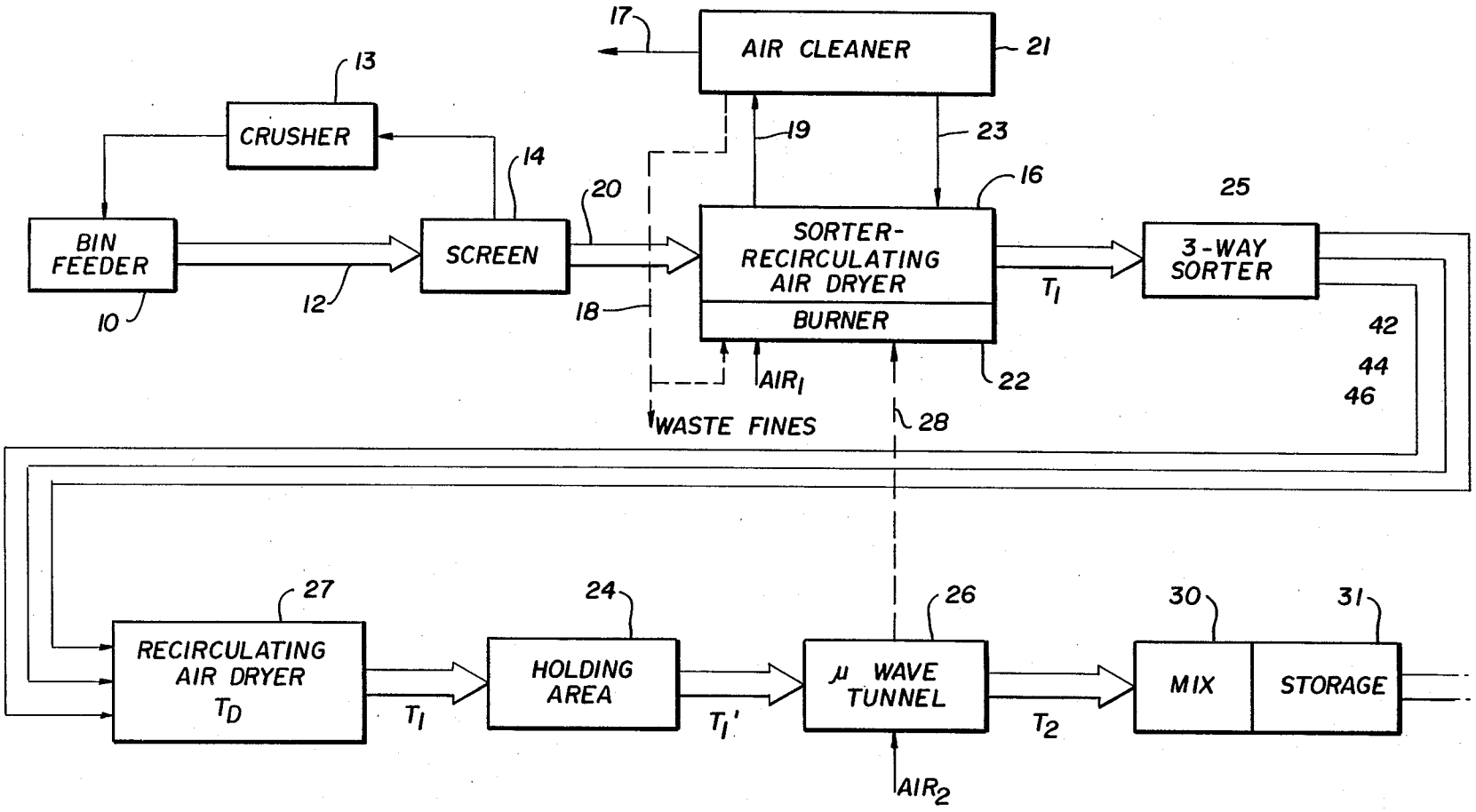
FIG. 1 shows in diagrammatic form the various steps of the method of this invention.

FIG. 1 is a diagram showing an apparatus lay-out for practicing the method of this invention. The reclaimed asphalt paving (RAP) is first placed in a bin feeder (10) which supplies RAP to a conveyor 12. The conveyor 12 may be a reciprocating plate type, or a belt conveyor. The RAP is fed to screen sorter 14 where the larger particles in the RAP are separated out. The larger particles are 125% of the largest diameter stone for the specification. The maximum size is selected according to specific job needs. Particles in excess of 1.25 times the maximum stone diameter for specification are fed through a crusher 13 which reduces the size and returns the reduced RAP back to bin feeder 10 for reinsertion into the process along conveyor 12.

The particles passing screen 14 are then fed to the sorter-air dryer 16 which provides for sorting out of fines which are less than a desirable size (less than 100 mesh), and for drying and heating of the particles of RAP to be retained in the process. The sorter air dryer velocity may be in the order of 100 mph, and in accordance with this invention, the sorter separates out waste fines which are less than 100 mesh from the RAP. The air of the sorter-air dryer is also heated to begin raising the temperature of the RAP.

The sorter air dryer 16 exhausts air at 19 which is fed to an air cleaner 21. The air cleaner removes fines from the exhaust and these fines are fed out along -line 18 and may either be fed to air bags, or returned to the air dryer burner for consumption during the combustion process. The air cleaner also returns warm exhaust air at line 23 to the sorter air dryer. This exhaust air which is utilized in the recirculation of the dryer 16. The fines that are removed may be collected in cleaner bags and disposed of, or may be collected and used in conjunction with the fuel supply for the burner of the recirculating air dryer 16. In FIG. 1, the use of the waste fines is depicted by dashed line 18 from the air cleaner 21 to the recirculating air dryer burner 22. The conveyor section 20 carries the RAP which has a size less than 1.25 times the diameter of the largest permitted of the specification from the screen sorter 14 to the recirculating dryer 16. The conveyor belt 20 may be a rubber or stainless steel conveyor belt, however, the material is not critical at this location.

After the RAP has passed through the air sorter and recirculating air dryer 16, it may be further sorted by the use of a conventional 3-way mesh sorter 25 in order to provide further breakdown of the RAP material in accordance with size. In the embodiment depicted graphically in FIG. 3, it is shown $+\frac{3}{8}$, $\frac{3}{8}-\frac{1}{8}$, and $-\frac{1}{8}$ material which is fed into three separate conveying belts, 42, 44, and 46. The 3-way mesh sorter 25 may also be incorporated into the sorter 14.

As the RAP leaves 3-way sorter 25 on conveyors 42, 44 and 46, it may be fed to a recirculating air dryer 27. This second recirculating air dryer raises the heat of the RAP and applies heat in accordance with the size of the RAP in order to achieve the most efficient heating. Large pieces of RAP contain asphaltic cement, and aggregate, and have a very low heat convectivity rates. For this reason, it is important to heating performance to have the minimum possible dimension particle fed into the dryer. By sorting into three different paths, the drying rates may be controlled in accordance with particle size. Recirculating air dryer 27 and 3-way sorter 25 are a further refinement of the basic system which relies upon sorter recirculating air dryer 16 and the additional step of microwave heating at tunnel 26. The use of two recirculating air dryers 16 and 27 provides for more efficient heating of the RAP because of particle size separation.

The recirculating air dryer 16 includes a burner 22 which supplies heat. In operation, the recirculating air dryer recirculates hot air from the drying region, where the RAP is located, back to the burner. In this way, heat contained in the drying air is not lost to the process. A portion of the recirculating gases in the dryer are exhausted (17) during each cycle, and additional fresh air ($Air_1$) is added during each cycle. An air cleaner 21 is provided to separate out fines and dust from the exhaust 17. The additional fresh air is supplied in the amount necessary to provide oxygen to the burner, and maintain a proper moisture percentage in the recirculated air.

If a plurality of belts of sized material is used as generally indicated in FIG. 3, the air dryer 27 may be separated into three separate air drying units, each capable of providing the appropriate amount of heat and air velocities for raising the temperature of the previously sized material passing through it.

Additional efficiency may be realized in the air dryer 27 in accordance with the methods schematically set forth at FIG. 3. Here, high temperature gases (350° to 450°) are applied to the exit portion of the RAP material passing through the feeding tunnel. The top (input) temperature chosen for the hottest gasses is selected as the highest temperature which the RAP stream being treated will take without smoking. In the region denoted, III, the gas temperature is lowered from the initial temperature $T_{d1}$ which may be 350° to $T_{d2}$ which may be 290°. Likewise, in region II, the gas temperatures are further lowered from $T_{d2}$ to $T_{d3}$ which may be in the order of 220°. Finally, in region I, the gas temperature is reduced from 220° to 170° or $T_{d4}$. As the RAP passes into the tunnel, it may be at an ambient temperature of 70°, and after passing through region I it may reach a temperature of 150°. After passing through region II, the temperature may reach 200°. After passing through the region III, the RAP may reach a temperature as great as 270°. In this manner, the higher heat $T_{d1}$ is applied to the hottest RAP passing through the tunnel, and the cooler gases are applied to the lower temperature RAP. A large amount of heat may be removed from the heating gases prior to their recirculation as compared to a single stage heater where the gases are inserted at 350° and removed after they make a single pass across the RAP. In such single pass systems, the exit temperature is substantially greater than $T_{d4}$, because the tunnel length and passage time for the material are small.

The RAP, when inside the recirculating air dryer experiences rapid drying due to the high heat of the recirculating air (300°–450° F.), and also drying due to the high velocity (impingement) of the gases within the recirculating air dryer. The gas is applied at right angles to the material bed through slits or pipes or other means of producing high velocity local air streams inside the dryer compartment. A high speed air stream applied parallel to the material will have far less heating effect. The velocity of this gas may be on the order of 100 mph. The high velocity of the continuous convection within the recirculating air dryer removes the water from the surface of the RAP within the dryer. Since this removal is rapid, the pieces of RAP will be heated to a higher temperature at their surface than at their interior.

It is desirable to raise the temperature of the RAP as high as possible while it is in the recirculating air dryer 27. The limit on the achievable temperature is determined by the temperature at which th RAP begins to smoke and where the heat causes degradation of bituminous materials in the RAP. It has been found that the RAP can be raised to a temperature of approximately 270° (Temperature $T_1'$, FIG. 1) without causing undue smoking and/or burning. The temperature of the dryer air $T_d$ may be in the order of 300°–450° F., but since the application to the RAP is rapid, the actual RAP temperature is not raised above $T_1$.

The conveyor within the recirculating air dryer may be a typical conveyor belt, and may be of rubber or stainless steel.

In order to provide the most efficient and shortest time heating of the RAP material without causing smoking and damage, it has been found that it is desirable to combine the relative economic advantages of a conventional heater or recirculating air dryer 16 with advantages which may be achieved from a microwave tunnel 26. In FIG. 2, there is shown in graphic form, the way the two heat sources may be combined to provide efficient and fast heating of the RAP to its desired temperature, 300°–350° ($T_2$). Conventional heaters which have a gas temperature in excess of 350° to 450°, are capable of heating RAP at rapid rates, but they suffer the severe disadvantage of also producing degradation of asphaltic material with consequent smoke, and damage to the asphaltic materials. This is provided by the high heat which is in excess of the temperature that the asphalt can reasonably stand without damage. As shown in FIG. 2, the maximum temperature that the asphaltic material is usually raised to is the temperature $T_2$ or 270° to 350°. If a conventional heater is used to raise the RAP temperature from ambient to 350°, a very substantial period will be required because at the higher RAP temperatures, heat transfer to the RAP is very slow, and hence heat gain is very slow. Therefore, a substantial period of time will be required to raise the temperature of the RAP as the temperature approaches $T_2$. In order to avoid this limitation, this invention raises the temperature of the RAP by means of conventional heater only to a temperature $T_1$. Upon reaching temperature $T_1$, the material is removed from the conventional heater (16), and is passed through a microwave tunnel 26. Since the microwave heating is internal to the RAP and uniform, the rock temperature is rapidly raised to the desired temperature of 330°, but the exterior of the rock is not raised to temperatures in excess of 330°. By microwave heating, the rock material itself is raised in temperature while the asphaltic material on its surface is much less absorbitive of microwaves. The asphaltic surface then absorbs heat from the now heated rocks, and rises in temperature. In this way, the temperature of the asphaltic material is prevented from exceeding 330°, while the RAP material is heated to the desired 330° in a rapid and efficient manner. The microwave transparent RAP by receiving its heat from the rock reaches only the mass average temperature.

The RAP on departing the air recirculating air dryer 16 is at a temperature $T_1$. The RAP at this point in the process, however, may not be of a uniform temperature since the interior of larger particles will be much cooler than the exterior of the particles. For this reason, it may be necessary to provide a holding area 24 for allowing time for the heat to spread through the particles and provide a more uniform temperature. The holding area 24 may be a bin/feeder, or merely a long stretch of conveyor which provides the time lag necessary for even heat distribution. The temperature $T_1'$ indicates the temperature of the RAP which has now achieved a more uniform distribution by having passed through the holding area 14. This is also known as the mass average temperature of the RAP.

The RAP at temperature $T_1'$ is then fed to a microwave tunnel heater 26. In the microwave tunnel heater, the RAP is raised to a temperature of approximately 300° to 330°. In the microwave tunnel, the microwaves heat the rock, but do not directly heat the bituminous materials in the RAP. By heating the rock, the bituminous materials are also heated by conduction. The RAP in the microwave tunnel at higher temperatures may emit some vapor and smoke laden gas. This gaseous material is continuously removed from the microwave tunnel by the injection of hot $air_2$ into the tunnel. The $air_2$ is of a low velocity, but sufficient to remove the excess of build-up of gas and smoke in the tunnel. $Air_2$ is maintained at the desired temperature of the finished RAP to prevent heat loss to the air. This removal is necessary so that conditions do not develop which will cause shorting and arcing within the tunnel.

The gases (28) removed from the tunnel may then be supplied to the burner section 22 of the recirculating air dryer 16, or to the burner of air dryer 27 it used. These exhaust gases contain hydrocarbon materials which may contribute to the combustion process, and are also at a high temperature so that heat is provided to the recirculating air dryer 16.

The RAP on departing the microwave tunnel 26 is at a temperature $T_2$, which is on the order of 300° to 330°. The limit on the temperature of the RAP departing the microwave tunnel is also a function of the temperature at which the RAP experiences degradation of the bituminous compounds, and the generation of excess smoke.

The microwave tunnel 26 may be constructed as shown in FIG. 4. It has been found that the RAP material when passing within twelve inches or more of the magnetrons 52 (microwave applicators (antennae)) is more effective than where applicators are placed more closely to the load. Applicators placed in close proximity to the load are more subject to arcing and uneven heating of the material.

In addition to providing a proper separation between the RAP and the magnetrons 52, it has also been found that placement of a fiberglass blanket between the magnetrons 52 and the RAP will provide a barrier to smoke, and dust which may arise from the RAP material. In this way, the smoke and dust does not cause distortions in the microwave field and consequent arcing or generation of flame in the area of the conveyed RAP. As illustrated in FIG. 5, the fiberglass blanket 54 may be in the form of a continuously moving belt of fiberglass material placed above the RAP. By moving the belt at the same speed as the passing RAP, rubbing and other dust generation between the belt and RAP is eliminated. The top half of the rotating fiberglass belt may pass either below the applicator, or above the applicator. If the belt passes below the applicator, yet a further layer is provided which deters the passage of dust and/or vapor from the RAP material to the antenna/applicator. By the use of the fiberglass 54, the tendency of the microwave oven to arc and flame can be substantially reduced.

The microwave tunnel 26 is also preferably built of aluminum or stainless steel 50 which does not absorb or allow exchange of the microwave radiation. Also better than painted steel which will pit and corrode and eventually cause loss in electromagnetic performance. Similarly, the conveyor belt 56 is constructed with fabrics which are transparent to microwave does not react with the microwave energy to any substantial degree.

A mixing mill and storage container 30 receives the RAP at temperature $T_2$ from the microwave tunnel 26. This mill may be an auger screw-type, or a pug mill. The mill mixes the RAP with additional rejuvenating agents which are added to the RAP in order to provide a usable asphaltic paving compound. The rejuvenating agents may be bituminous compounds, rock, or any other material desired which will provide the proper specifications for the asphaltic concrete.

DETAILED DESCRIPTION OF A PREFERRED EMBODIMENT OF THE AIR DRYER

In FIG. 6 there is shown a cross-sectional view of the air dryer tubes 61 and conveyor belt carrying RAP 64 beneath it. The plenum 60 supplies air to a plurality of tubes 61 under sufficient pressure so that the velocity of the air exiting the tubes 61 is in the order of 100 mph. When the high velocity air strikes the RAP 64, the RAP is formed into wind rows between each pair of pipes. A clear space 63 is formed on the conveyor belt 62 beneath each tube as the belt moves along.

FIG. **6*a* shows a cross-section of a recirculating air sorter-dryer of the type to be used in the process and depicted as 16 and 27 of FIG. 1. The dryer includes a heater and fan section 70 which includes fans and burners for supplying hot air to the plenem 60 and the air insertion tubes 61. Air striking the RAP 64 is then returned to an air cleaner 72 which may be located on both sides of the dryer 70 and conveyor belt 62. As air passes away from the RAP and up the ramp 74, fine particles will be carried over into the cleaners 72 while larger particles will fall back down onto the conveyor belt. The size of particles which pass over to the air cleaner may be controlled by varying the cross-sectional width of the passage 76 which connects the air cleaner to the high velocity air insertion region at the RAP 64. As material passes through the passage 76, larger particles will fall down on the ramp 74 and be returned to the conveyor belt 62. The exhaust 17 from air cleaner 21 provides for escape of used and now clean air. The clean and recycled air then is passed back to the sorter-dryer in conduit 23. The recycled air is received by the fan and burner sections 70** which heats the air and pressurizes it for further recycling through the apparatus as described previously.

In FIG. **6*b*, there is shown a cross-sectional view of the fan and burner section of the recirculating air dryer 70. Burner 78 heat the air and fans 80 compress the air at plenem 60 in order to provide a supply of air to the insertion tubes 61. In the particular embodiment of FIG. 6, the burner 78*a* is used to provide heat to a first section of the dryer which provides for dedusting and water evaporation. This function is the function described with respect to sorter recirculating air dryer 16 as shown in FIG. 1. Burner 78*b* is used to supply a second section of the air dryer which provides dryer heat to the clean asphalt material. The heat supplied by burner 2 to tube 61 may be in the order of 450°–500° F. The temperature of the air supplied from burner 78*a* to the tubes below it may be in the order of 350° F. as opposed to the higher heat provided by the section supplied by burner 78*b***.

The sorter recirculating air dryer shown in FIG. **6*b* may be used for the sorter recirculating air dryer 16 as depicted in FIG. 1. The sorting function is performed by the cleaner 72 and the ramp 74 which passes only the finer particles into the cleaner 72. The drying function is provided by the heat applied during the sorting process as well as the heat supplied during the subsequent higher heating process as supplied by burner 78*b***.

In FIG. 1 there is also shown a 3-way sorter and a second recirculating air dryer 27 which receives as many as 3 different paths of sorted RAP. This further sorting and heating by recirculating air dryer 27 is a further refinement on the process of recycling the RAP. The fundamental process, however, may be operated by eliminating the 3-way sorter 25 and the second recirculating air dryer 17 and relying only on the first recirculating air dryer 16 to provide the heated, dried and fine free RAP to the holding area 24.

Also, the RAP may be sorted into a plurality of size groupings at the screen sorting location 14 prior to entering on a plurality of conveyor belts into recirculating air dryer 16.

In FIG. 7, there is shown a top view of the RAP on the belt 62 as shown in FIG. 6. The tubes 61 produce a space beneath them which is clear of RAP, and this clear space 63 remains until the RAP is pushed back into it by the next succeeding set of tubes 61. Reference no. 65 indicates the undulating line which identifies the high point of the RAP as it moves along the conveyor belt. It can be seen that the RAP is pushed back and forth sideways across the conveyor belt 62 as the tubes 61 apply air to the RAP. Tubes 61 are shown, but any means for applying a high velocity stream of air may be used at the air injection locations.

It has been determined that the best overall drying characteristics are obtained when the velocity from the air from the tubes 61 is sufficient to provide a clear area of the conveyor belt. 62. The clear space on the belt 62 is a good measure of sufficient agitation of the RAP on the belt. The shifting of the RAP on the belt provides movement of the RAP which in turn provides different surface areas of the particles in the RAP which are exposed to the direct air blast from the tubes 61. When different material surfaces are brought into contact with the dryer, the speed and efficiency of the air drying is substantially increased. If the velocity from the tubes 61 is insufficient to provide a clear space on the belt 62, then there will be insufficient material shifting to uncover the surface of all of the RAP particles on the belt 62.

The supply tubes 61 are staggered in a direction generally perpendicular to the movement of RAP on the belt so that each row of tubes shifts the RAP in a direction perpendicular to the travel of the belt.

The recirculating air dryer as shown in FIG. 6 and FIG. 7 is provided for each selected portion of the RAP which requires separate treatment. A separate air dryer is provided for each of the conveying belts, 42, 44 and 46 as illustrated in FIG. 3 and FIG. 1.

MOISTURE CONSIDERATIONS IN RAP TREATMENT PROCESS

It is known that substantially all of the moisture in milled RAP is found on the surface of the particles. Still further, proportionally more of the total moisture is on the surface of the small particles than on the large particles. This is due to the fact that the small particles have a much greater surface area per unit volume or weight than do the large particles. Drying with high velocity air actually enhances removal of very fine particles. It has been found that when the fines are wet, they cling to the larger particles by surface tension. However, when water is evaporated and the particles agitated, they are more easily picked up by the air stream.

Removal of the moisture through drying as in the prior art is expensive because it requires a large quantity of heat to vaporize the water, i.e., approximately 1000 BTU's per pound of water. Therefore, the step of sorting the fines out in the air sorter 16, reduces the total energy required by the process because it is no longer necessary to vaporize the water contained on the small particles or fines. The quality of the asphaltic concrete mixture is not damaged by removal of the small particles because these particles are mainly the result of the milling process and are not desirable in the final product.

A hot gas high speed air process of the type produced by the recirculating dryer 16 is generally a more economical way to evaporate moisture than by using microwave energy. The recirculating air dryer process evaporates the water and provides a dry preheated stream of RAP at temperature $T_1$ as the input for the microwave processor 26. In this manner, the least amount of energy possible is expended on removal of the water from the RAP.

In addition to giving an overall greater system efficiency, the water-free and fines-free asphalt fed to the microwave heater also enhances the microwave processing by eliminating vapor and dust which may lead to arcing within the microwave heater. This in turn reduces the danger of fire and explosion within the microwave tunnel. Also, microwave reflexion is reduced by the removal of these undesirable products. Damage to magnetrons is also prevented by reduced arcing.

IMPROVED ASPHALTIC CONCRETE

It is well known that asphaltic cement materials give off visible smoke and are damaged to some extent when processed at a relatively high temperature. When the RAP is heated by hot gas streams in conventional heaters, the gas must be much higher than the desired temperature of the RAP ($T_2$), approximately 300° to 350°.

The temperature $T_2$ is in the range of 350°–300° F., the temperature necessary to provide proper lay down and compaction of the asphaltic material. High heat is necessary so that there will be rapid heat transfer from a hot gas into the RAP. This high heat at the RAP surface produces degradation of the bituminous compounds, excessive smoke, and gas which are a significant source of air pollutants, and which are undesirable in asphaltic pavement recycling conducted in urban areas.

Ideally, the surface and interior temperature of the RAP materials should not go above the desired output temperatures. In this way, smoking and degradation is substantially eliminated. By this process, the microwave provides heat to the rock portion of the RAP, but does not directly heat the asphalt. Therefore, the asphalt suffers no damage when the RAP is brought to the desired temperature in the microwave section.

APPARATUS USED

An air sorter is used because it will provide for effective separation of particles with low wear and simple mechanical systems. In contrast, normal mechanical cleaners such as screens are ineffective for removing fine particles in the RAP because the RAP tends to stick to the screens and clog them.

The air dryer preferably uses an air impingement method which provides improved efficiency in the air dryer. In the air dryer, air is forced into a thin layer of RAP lying on the conveyor by the use of small diameter tubes which inject air at a high velocity (100mph). By high velocity hot air injection, the hot air molecules are placed in close proximity to the surface of the RAP particles. This reduces the insulating nature of the stationary air layers which exist at the particle boundary. The particle boundary layer removal (impingement) provides significant advantages over the normal low air velocity and flow methods previously used in processing of asphaltic concrete.

The present invention may be embodied in other specific forms without departing from the specific or essential attributes thereof. Reference should be made to the appended claims rather than to the foregoing specification as indicating the scope of this invention. The scope of this invention also includes reasonable equivalence thereof.

I claim:

1. Apparatus for removing moisture from reclaimed asphaltic paving (RAP) comprising:

a belt conveyor for carrying a layer of RAP while moisture therein is removed, an air dryer having a plurality of air injection tubes in staggered relationship along the direction of travel of the belt, the tubes being positioned above the belt to blow heated air downwardly onto the layer of RAP, means to heat air being used in the air dryer, means to blow heated air through the tubes at a velocity sufficient to clear the RAP from the belt immediately beneath the tubes and to push the RAP back and forth sideways across the conveyor belt as the belt carries the layer of RAP below the tubes.

2. A method for removing moisture from reclaimed asphaltic paving (RAP) comprising:

passing a layer of RAP on a moving belt through an air dryer, injecting heated air downwardly at a plurality of locations onto the RAP as it passes through the air dryer, the air injection locations being in staggered relationship along the direction of travel of the belt, and the air being injected at a velocity sufficient to clear RAP from the belt immediately below the injection locations and to push the RAP back and forth sideways across the conveyor belt as the RAP moves on the conveyor belt below the injection location.

3. The apparatus of claim 1 wherein air dryer is a recirculating air dryer.

4. The method of claim 2 further comprising the step of sorting said RAP into different size classifications prior to placing one sorted size of RAP on said conveying means.

5. The method of claim 2 wherein said velocity is in the order of 100 mph.

6. The method in accordance with claim 2 wherein said air is heated to a temperature in the range of 300°–450° Fahrenheit.

7. The method in accordance with claim 2 wherein said air is injected by a plurality of tubes.

8. The method in accordance with claim 2 further including the step of sorting said RAP into different sizes and injecting said air into said different RAP sizes.

* * * * *